US010422123B2

(12) United States Patent
Holland

(10) Patent No.: US 10,422,123 B2
(45) Date of Patent: Sep. 24, 2019

(54) CONCEALED JOIST TIE WITH SLOPED CENTER FLANGE

(71) Applicant: Rachel Marie Holland, San Ramon, CA (US)

(72) Inventor: Rachel Marie Holland, San Ramon, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 0 days.

(21) Appl. No.: 15/805,977

(22) Filed: Nov. 7, 2017

(65) Prior Publication Data

US 2018/0127971 A1 May 10, 2018

Related U.S. Application Data

(60) Provisional application No. 62/497,096, filed on Nov. 7, 2016.

(51) Int. Cl.
*E04B 1/26* (2006.01)
*E04B 1/48* (2006.01)

(52) U.S. Cl.
CPC ..... *E04B 1/2612* (2013.01); *E04B 1/26* (2013.01); *E04B 1/486* (2013.01); *E04B 2001/2648* (2013.01); *E04B 2001/2652* (2013.01); *Y10T 403/345* (2015.01); *Y10T 403/46* (2015.01)

(58) Field of Classification Search
CPC ..... E04B 1/2612; E04B 1/486; E04B 2001/2652; E04B 2001/2648; E04B 1/2604; E04B 1/2608; E04B 2001/2636; E04B 2001/2696; E04B 1/26; E04B 2001/1918; Y10T 403/46; Y10T 403/1616; Y10T 403/345; Y10T 403/42; Y10T 403/4681;
(Continued)

(56) References Cited

U.S. PATENT DOCUMENTS 1,723,500 A * 8/1929 Campbell ..... E04B 9/22 52/447
1,771,856 A 7/1930 McCullough
1,842,786 A 1/1932 Kirsch
(Continued)

FOREIGN PATENT DOCUMENTS

DE 9001067 U1 * 4/1990 ..... E04B 1/2612
DE 4124553 A1 * 3/1992 ..... E04B 1/2604
(Continued)

OTHER PUBLICATIONS

"CBH/Etrier àâme intérieure", catalog, 2014, one page plus front and back cover, C-2014, Simpson Strong-Tie, France.
(Continued)

*Primary Examiner* — Ryan D Kwiecinski
*Assistant Examiner* — Matthew J Gitlin
(74) *Attorney, Agent, or Firm* — James R. Cypher; Charles R. Cypher

(57) ABSTRACT

A connection between a first, supporting structural member, such as a post or header, and a second, supported structural member such as a joist or rafter is provided, wherein the connection is made with a connector and fasteners, the use of which can be substantially hidden from view. The connector is designed to be inserted in a slotted opening in the second, structural member and to attach to a surface of the first, supporting structural member.

19 Claims, 12 Drawing Sheets

(58) Field of Classification Search
CPC . Y10T 403/553; Y10T 403/55; Y10T 403/73; Y10T 403/75
See application file for complete search history.

(56) References Cited

U.S. PATENT DOCUMENTS

| | | | | | |
|---|---|---|---|---|---|
| 1,875,805 | A | | 9/1932 | Dickson | |
| 3,907,445 | A | | 9/1975 | Wendt | |
| 3,945,741 | A | | 3/1976 | Wendt | |
| 3,989,398 | A | | 11/1976 | Wendt | |
| 4,260,277 | A | * | 4/1981 | Daniels | E04B 1/2612 403/235 |
| 4,558,968 | A | | 12/1985 | Meickl | |
| 4,560,301 | A | | 12/1985 | Gilb | |
| 4,572,695 | A | | 2/1986 | Gilb | |
| 4,825,777 | A | * | 5/1989 | Cummins | B61F 5/32 105/225 |
| 4,893,961 | A | | 1/1990 | O'Sullivan et al. | |
| 4,897,979 | A | | 2/1990 | Colonias | |
| 4,920,713 | A | | 5/1990 | Børresen et al. | |
| 4,920,725 | A | | 5/1990 | Gore | |
| 4,932,173 | A | | 6/1990 | Commins | |
| 5,062,733 | A | | 11/1991 | Cholid et al. | |
| 5,186,571 | A | | 2/1993 | Hentzschel | |
| 5,217,317 | A | | 6/1993 | Young | |
| 5,253,945 | A | * | 10/1993 | Hosokawa | E04B 1/2604 403/258 |
| 5,274,981 | A | | 1/1994 | Commins | |
| 5,342,138 | A | * | 8/1994 | Saito | E04B 1/2604 403/187 |
| 5,380,115 | A | | 1/1995 | Colonias | |
| 3,267,624 | A | | 8/1996 | Wozniak et al. | |
| 5,577,856 | A | * | 11/1996 | Tezuka | E04B 1/2604 403/294 |
| 5,598,680 | A | | 2/1997 | Wilhelmi | |
| 5,617,694 | A | * | 4/1997 | Baba | E04B 1/2604 403/12 |
| 5,620,275 | A | * | 4/1997 | Novacek | E04B 1/2604 403/230 |
| 5,625,995 | A | | 5/1997 | Martin | |
| 5,657,596 | A | | 8/1997 | Powers, III | |
| 5,664,392 | A | | 9/1997 | Mucha | |
| 5,836,131 | A | | 11/1998 | Viola et al. | |
| 6,032,431 | A | * | 3/2000 | Sugiyama | E04B 1/2604 403/230 |
| 6,230,467 | B1 | | 5/2001 | Leek | |
| 6,446,409 | B1 | * | 9/2002 | Emerson | E04B 1/2608 403/232.1 |
| 9,920,531 | B1 | * | 3/2018 | Charest | E04C 3/12 |
| 2002/0025217 | A1 | * | 2/2002 | Mattle | E04B 1/2604 403/294 |
| 2005/0086897 | A1 | * | 4/2005 | Roesset | E04B 7/045 52/698 |

FOREIGN PATENT DOCUMENTS

| | | | | | |
|---|---|---|---|---|---|
| DE | 9205490 | U1 | * | 7/1992 | E04B 1/2608 |
| DE | 199312522 | U1 | | 2/1994 | |
| EP | 563121 | B1 | | 6/1994 | |
| EP | 1300521 | A1 | * | 4/2003 | E04B 1/2604 |
| EP | 1398423 | A2 | * | 3/2004 | E04B 1/2604 |
| EP | 2292856 | A3 | | 10/2012 | |
| EP | 2292856 | B1 | | 12/2014 | |
| JP | 6136839 | A | | 5/1994 | |
| JP | 10237947 | A | | 9/1998 | |
| JP | 2002180551 | A | | 6/2002 | |

OTHER PUBLICATIONS

"Statische Berechnungen Sichtholz-Verbinder", brochure, Feb. 1998, three pages, BS 297 02.8, Bulldog Simpson GmbH, Germany.
Search Report for European Patent Application 17200310.5, application part, Apr. 4, 2018, six pages plus cover sheet, European Patent Office, Germany.

* cited by examiner

CONCEALED JOIST TIE WITH SLOPED CENTER FLANGE

BACKGROUND OF THE INVENTION

The present invention relates to a connection between a first, supporting structural member, such as a post or header, and a second, supported structural member such as a joist or rafter. The connection is made with a connector and fasteners, the use of which can be substantially hidden from view. The connector is inserted in a slotted opening in the second, structural member and attaches to a surface of the first, supporting structural member.

German Utility Model No. 90 01 067 teaches a concealed joining element made from a sheet of relatively thin material whose effective thickness is increased by providing deformations or beads in the sheet metal so that the attachment web of the connector will fit more snugly in the slotted opening of the second structural member and thus prevent looseness in the connection.

German Utility Model No. 92 05 490 also teaches a concealed joining element made from a sheet of relatively thin material, but instead of providing the attachment web with deformations and beads to increase its effective thickness, the invention crimps or folds the material of the openings over on themselves to increase the effective thickness of the attachment web of the connector.

German Patent No. DE 41 24 553, published in March of 1992, teaches a two-part, concealed joining element. Two similarly-shaped, L-shaped members are joined together so that their larger flanges overlap to form an attachment web that is inserted into the slotted opening of the second structural member, and where the smaller flanges of the L-shaped members make up the fastening flanges that attached to the supporting structural member. The flanges that make up the attachment web are provided with deformations or embossed portions to increase the effective thickness of the combined attachment web.

U.S. Pat. No. 5,062,733, granted in 1991, teaches a concealed joining element with special openings for receiving the dowels that connect the attachment web of the joining element to the second structural member.

U.S. Pat. No. 5,598,680, granted in 1997, teaches a concealed joining element with special fastening flanges that extend to both sides of the attachment web.

SUMMARY OF THE INVENTION

The present invention provides a connection between a supporting structural member and a supported structural member made with a connector and one or more first fasteners and one or more second fasteners. The connector is constructed in such a manner that the connector has an attachment web that is inserted into a slotted opening in the second structural member. The connector and fasteners can be substantially hidden from view.

The connector has a substantially planar attachment web provided with openings. Dowels or second fasteners are received in the openings and connect the attachment web to the second structural member. In the preferred embodiment, the generally planar attachment web is inserted into a slotted opening in the second, supported structural member. Generally, the slot is provided at the end of the second, supported structural member. The dowels are inserted through bores in the second structural member that align with openings in the attachment web. The connector is attached to the first structural member by means of one or more fastening flanges. Preferably, there are three fastening flanges. The fastening flanges are connected to the attachment web and are preferably formed from the same material as the attachment web and represent portions of the connector bent at an angle to the attachment web. Preferably, the fastening flanges are bent orthogonally to the attachment web with selected fastening flanges bent to opposite sides of the attachment web. The fastening flanges preferably receive fasteners that are driven through the fastening flanges and into the first structural member. Preferably the fasteners that attach the fastening flanges to the first structural member are self-drilling screws when the first structural member is made from wood or a similar material.

According to the present invention, the lower bracketing edge of the attachment web, proceeding from the juncture between the attachment web and the fastening flange nearest the termination point of the lower bracketing edge, runs at an acute angle to the plane of the fastening flange nearest to the lower bracketing edge and to the portion of the rear edge nearest the termination point. Generally, although it is not required for the invention, the plane of the fastening flange nearest the termination point will be vertically disposed.

In a further embodiment of the invention, the angle or slope of the lower bracketing edge changes at one or more intermediary points spaced along the bracketing edge.

In a further embodiment of the present invention, one of the fastening flanges and the attachment web meet at an intersection that is the lowest portion or point of the connector. The fastening flange and the attachment web diverge from this point of intersection. The bracketing edge of the attachment web slopes upwardly from the lowest portion of the connector.

According to the present invention, the lower bracketing edge can be a curved edge whose slope increases until it approaches a vertical orientation where it merges with the outer edge of the attachment web.

According to the present invention, the openings in the attachment web are provided at selected locations with respect to the upper and lower bracketing edges of the attachment web, and the outer edge of the attachment web.

According to the present invention, the slotted opening provided in the second structural member is formed with a circular saw and the interior of the slotted opening has a curved face that represent the cut made by the circular saw.

Also according to the preferred form of the invention, the slotted opening is only visible on two surfaces of the second structural member, and where the slotted opening starts at one surface, the slotted opening does not extend through the second structural member to a surface oppositely disposed to the area on the second structural member where the slotted opening can be said to have started. Preferably, these surfaces are the end of the second structural member and the top surface of the second structural member when the second structural member is an elongated member extending away from a generally vertically disposed surface, such as where the first structural member is a header and the second structural member is an exposed joist or beam attached to the header. Thus the slotted opening is not visible from someone viewing the bottom of the second structural member from below.

Also according to the present invention, the connector of the present invention when used with a second structural member that is a glulam or parallel strand lumber beam having a width of 5⅛" and a height of 15" can achieve allowable load values for uplift of 9,210 pounds, for floor loads of 8,350 pounds, for snow loads of 8,465 pounds, and for roof loads of 8,465 pounds.

DETAILED DESCRIPTION OF THE INVENTION

Figure 1:
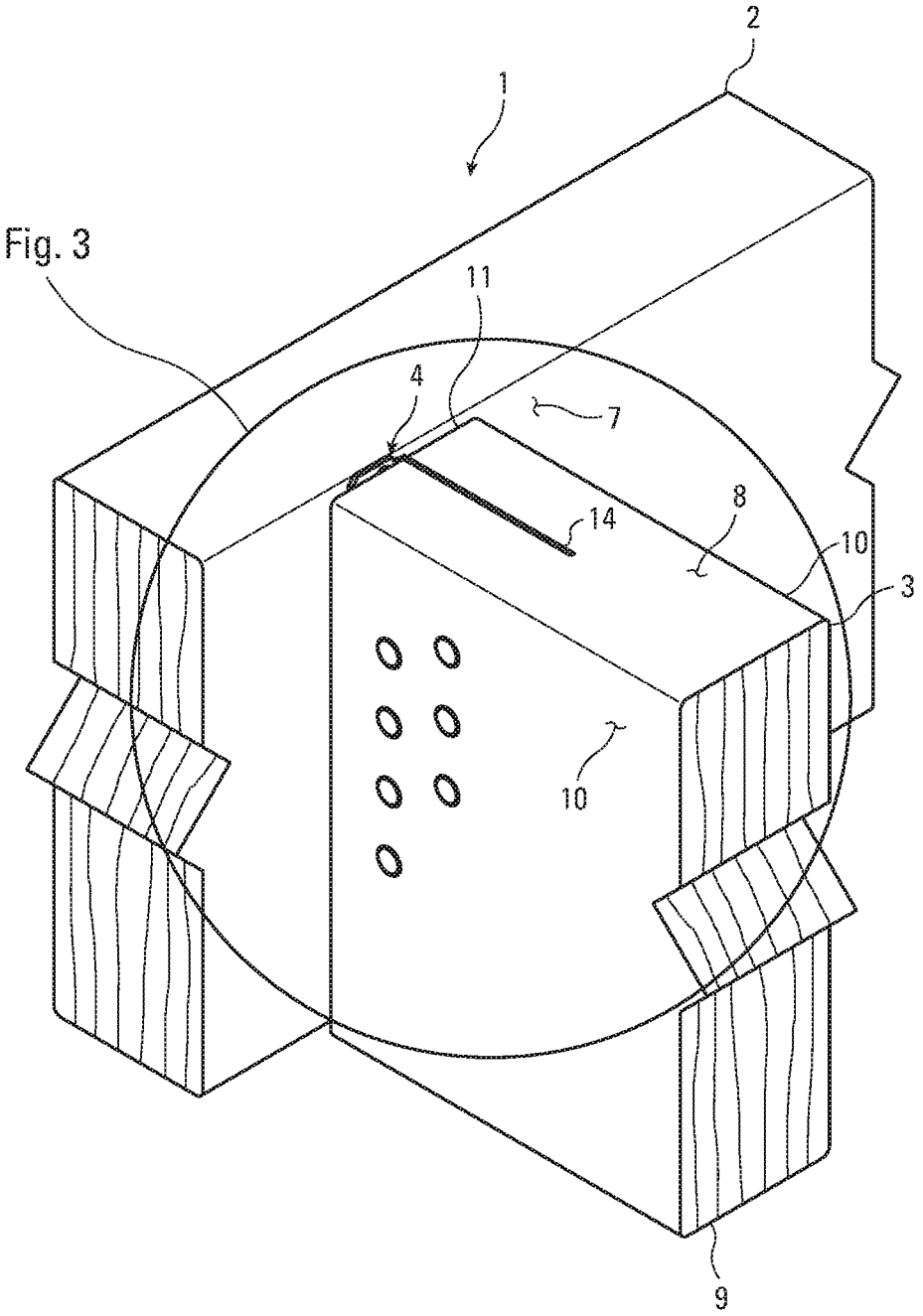
FIG. 1 is a perspective view of a connection formed according to the present invention.
Figure 2:
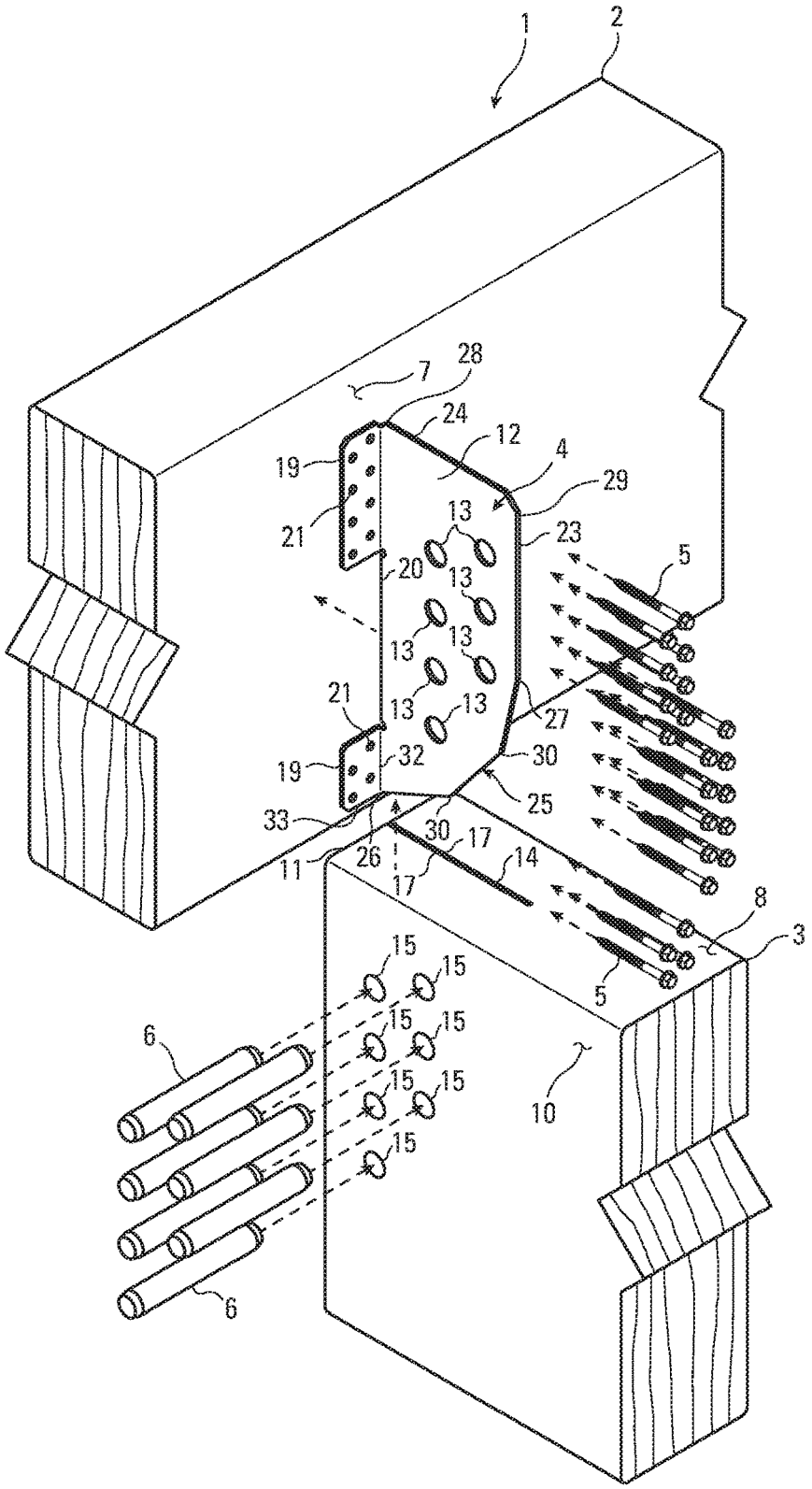
FIG. 2 is an exploded, perspective view of the connection of FIG. 1.
Figure 3:
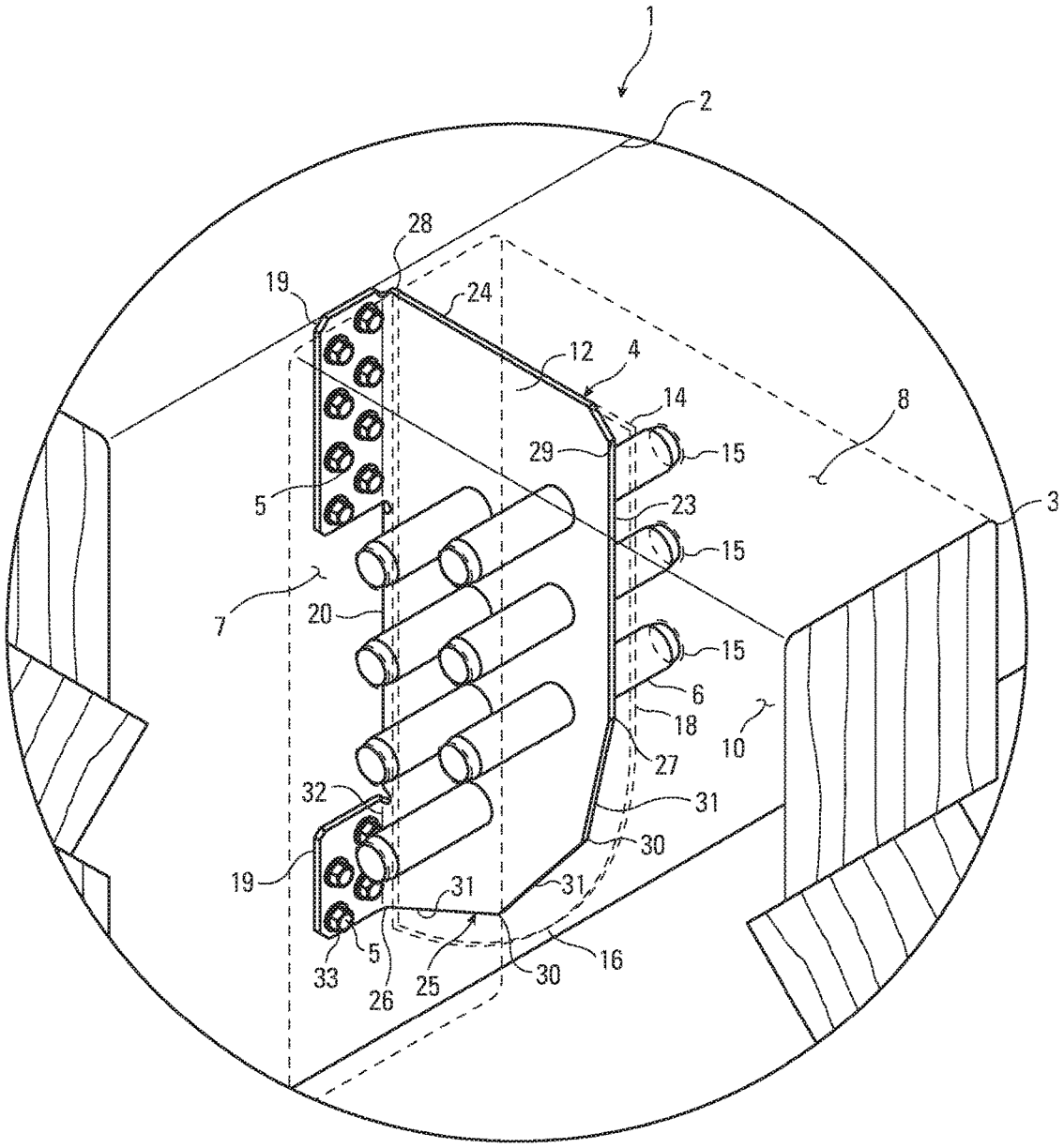
FIG. 3. is an enlarged view of the connection of FIG. 1 with the end of the second structural member shown in dotted lines.

As shown in FIGS. 1-3, the present invention provides a connection 1 between a supporting, first structural member 2 and a supported, second structural member 3 made with a connector 4 and one or more first fasteners 5 and one or more second fasteners 6. The connection 1 and the connector 4 are constructed in such a manner that the connector 4 and fasteners 5 and 6 can be substantially hidden from view. The first structural member 2 is preferably a post or a beam with a generally planar attachment surface 7. The second structural member 3 is preferably an elongated joist or a rafter abutting or substantially abutting the first structural member 2 at the attachment surface 7. The elongated second structural member 3 extends away from the first structural member 2, typically at an orthogonal angle.

As shown in FIGS. 1, 2, 12 and 13, the second structural member 3 is formed with a top surface 8, a bottom surface 9 that lies parallel to the top surface 8, and a pair of parallel side surfaces 10, all of which intersect with the abutment surface 11.

Figure 11:
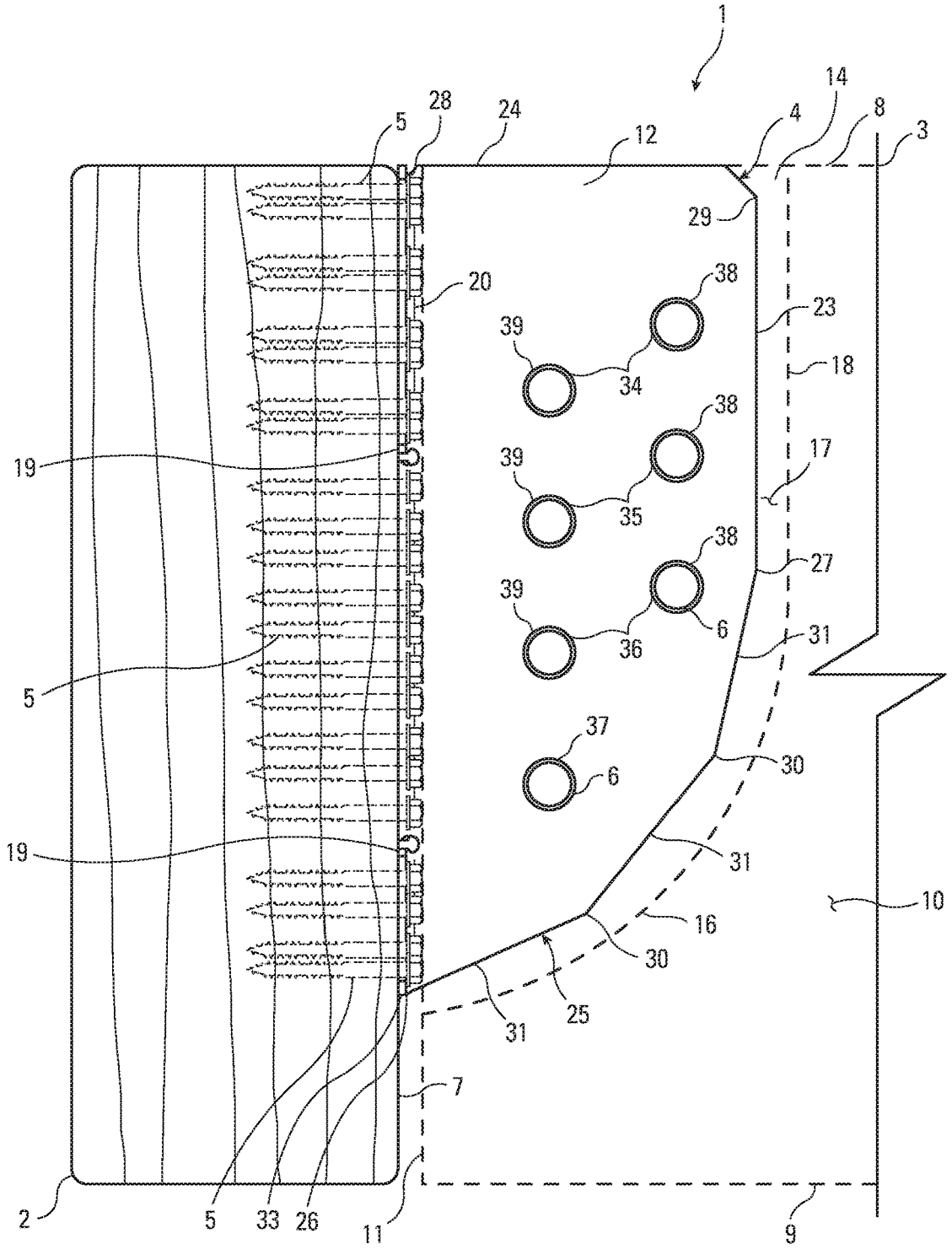
FIG. 11 is a side view of the connection shown in FIGS. 1 and 3 with the end of the second structural member shown in dotted lines.
Figure 12:
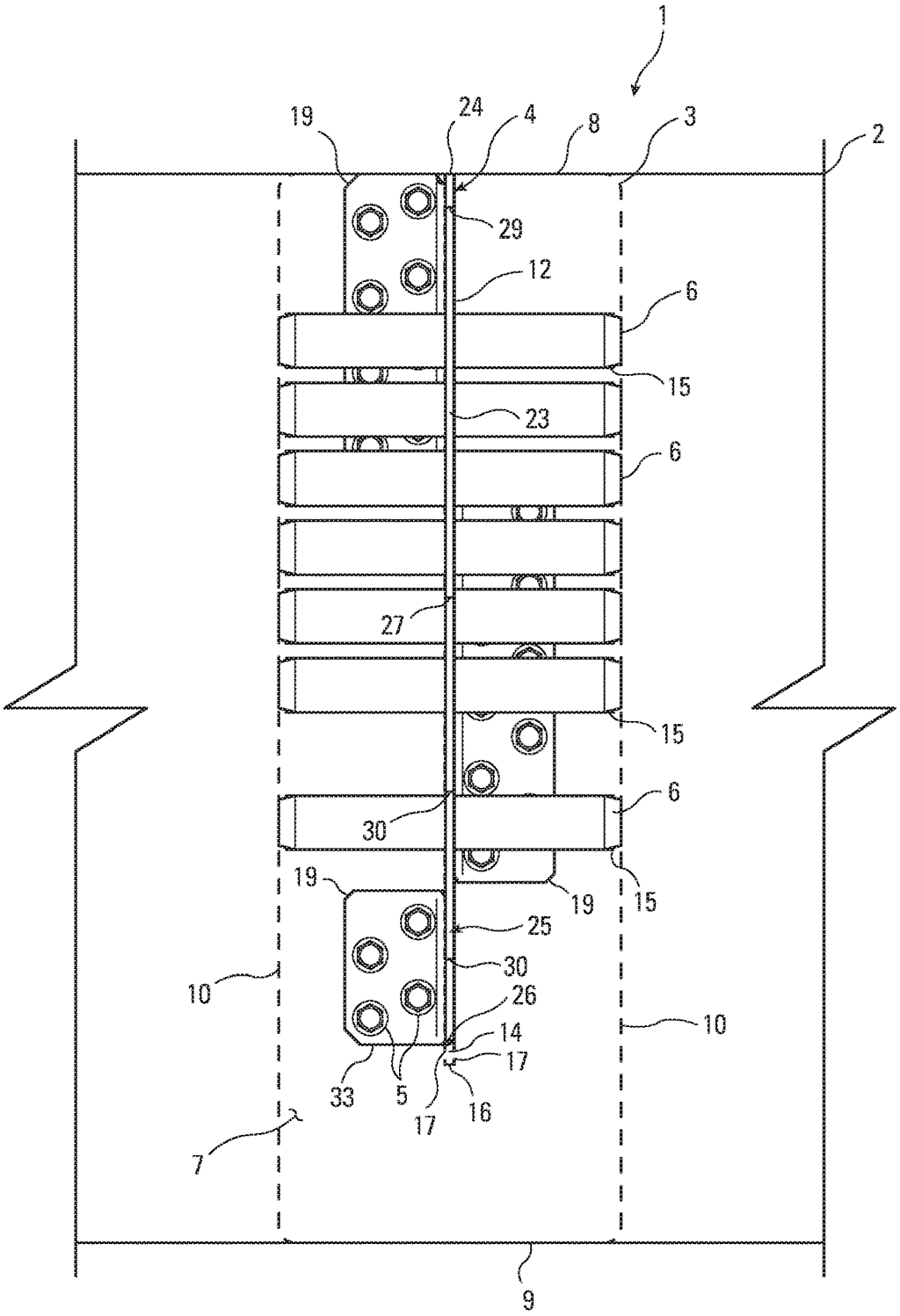
FIG. 12 is a front view of the connection shown in FIG. 11.
Figure 13:
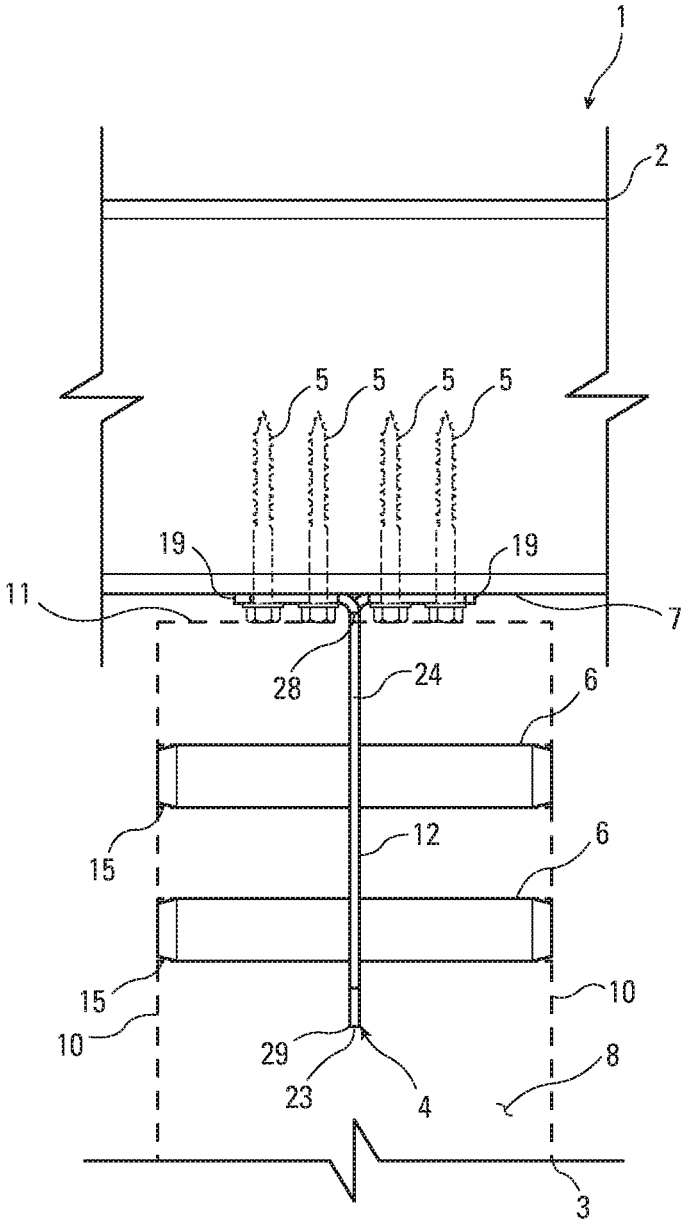
FIG. 13 is a top view of the connection shown in FIG. 11.

The connector 4 has a substantially planar attachment web 12 provided with openings 13. Dowels 6 are received in the openings 13 that connect the attachment web 12 to the second structural member 3. In the preferred embodiment, the planar attachment web 12 is inserted into a slotted opening 14 in the second, supported structural member 3. Generally, the slotted opening 14 is provided at the end of an elongated second, supported structural member 3. As shown in FIG. 2, the dowels 6 are inserted through bores 15 in the second structural member 3 that align with openings 13 in the attachment web 12. As shown in FIGS. 3 and 11, the slotted opening 14 is preferably made with a circular saw and the slotted opening 14 has a curved bottom wall 16 that has the same curvature as that of the circular saw blade that made the slotted opening 14, and thus has a curvature of generally a single radius. The slotted opening 14 has two generally parallel side walls 17 that are joined by the curved bottom wall 16 and by a generally straight front face 18.

Figure 4:
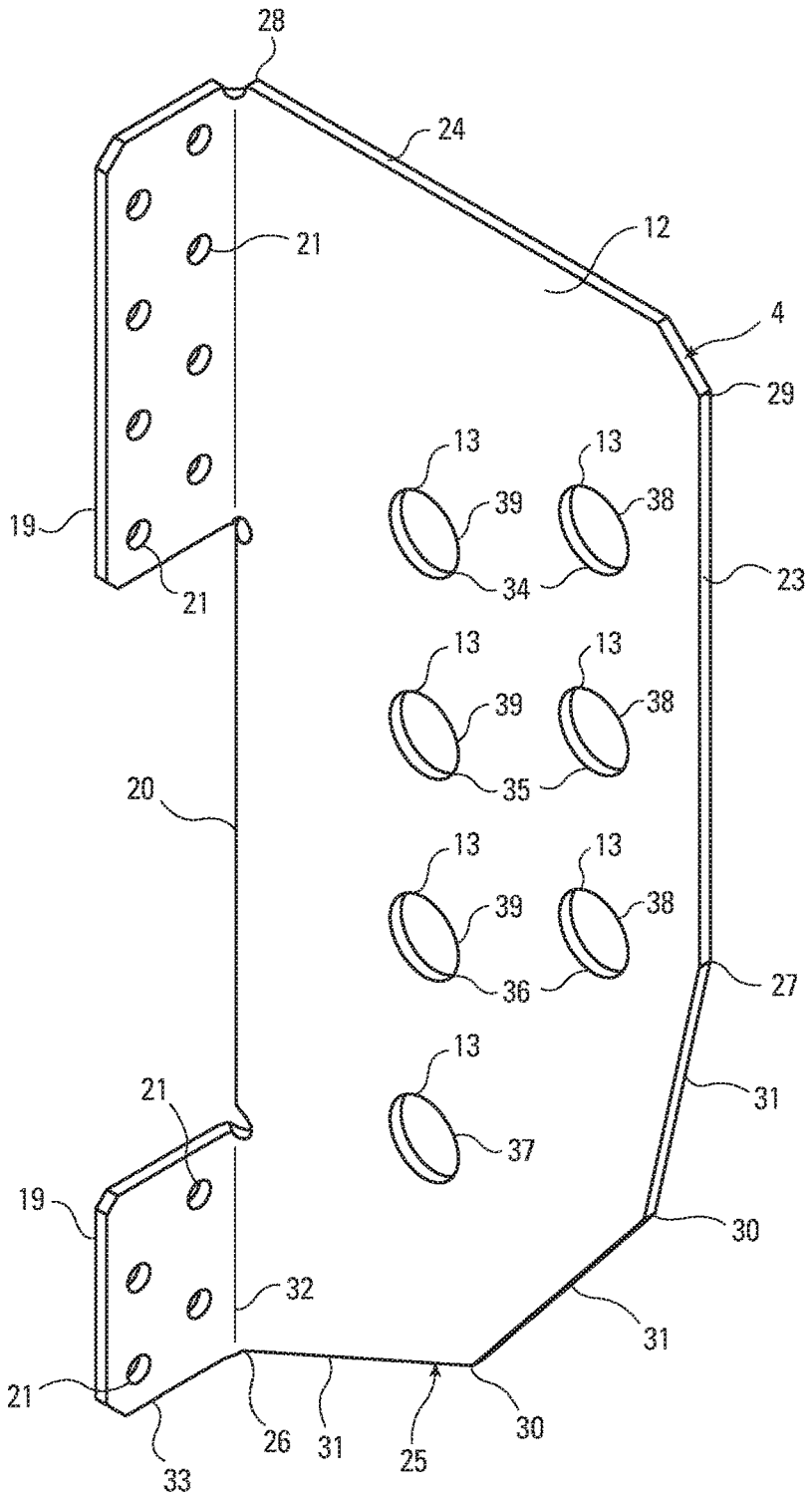
FIG. 4 is a perspective view of the connector of the present invention.

As shown in FIG. 2, the connector 4 is attached to the first structural member 2 by means of one or more fastening flanges 19. Preferably, there are three fastening flanges 19. The fastening flanges 19 are connected to the rear edge 20 of the attachment web 12 and are preferably formed from the same material as the attachment web 12 and represent portions of the connector 4 bent at an angle to the attachment web 12 at the rear edge 20 of the attachment web 12. The fastening flanges 19 are generally planar members. Thus the rear edge 20 of the attachment web 12 is also the bend line for and between the attachment web 12 and the fastening flanges 19. Preferably, the fastening flanges 19 are bent orthogonally to the attachment web 12 with selected fastening flanges 19 being bent to the left of the attachment web 12 and others being bent to the right of the attachment web 12. The fastening flanges 19 preferably receive the first fasteners 5 that are driven through the fastening flanges 13 and into the first structural member 2. Preferably the first fasteners 5 that attach the fastening flanges 19 to the first structural member 2 are self-drilling screws when the first structural member 2 is made from wood or a similar material. As shown in FIG. 4, preferably, openings 21 are provided in the fastening flanges 19 to make insertion of the first fasteners 5 easier and to direct the user as to the placement and number of first fasteners 5.

As shown in FIG. 4, the attachment web 12 is defined by an outer edge 23 and an oppositely disposed rear edge 20 near the abutment surface 11 of the second structural member 3 and upper and lower bracketing edges 24 and 25. The outer extent of the attachment web 12 from the attachment surface 7 of the first structural member 2 is defined by the outer edge 23. The inner extent of the attachment web 12 is defined by the rear edge 20 of the attachment web 12. An upper bracketing edge 24 extends from the rear edge 20 to the outer edge 23 at the top of the attachment web 12. A lower bracketing edge 25 extends from the rear edge 20 to the outer edge 23 at the bottom of the attachment web 12. The lower bracketing edge 25 meets the rear edge 20 of the attachment web 12 at a lower, rear termination point 26. The lower bracketing edge 25 meets the outer edge 23 of the attachment web 12 at a lower, outer termination point 27. The upper bracketing edge 24 meets the rear edge 20 of the attachment web 12 at an upper, rear end point 28. The upper bracketing edge 24 meets the outer edge 23 of the attachment web 12 at an upper, outer end point 29. Spaced along the lower bracketing edge 25 are one or more intermediary points 30 where the slope of the lower bracketing edge 25 with respect to the rear edge 20 of the attachment web 12 changes. The intermediary points 30 can be so closely spaced that the lower bracketing edge 25 is a curve, or as shown in the drawings the intermediary points 30 can be spaced along the lower bracketing edge creating defined lower bracketing segments 31.

Figure 5:
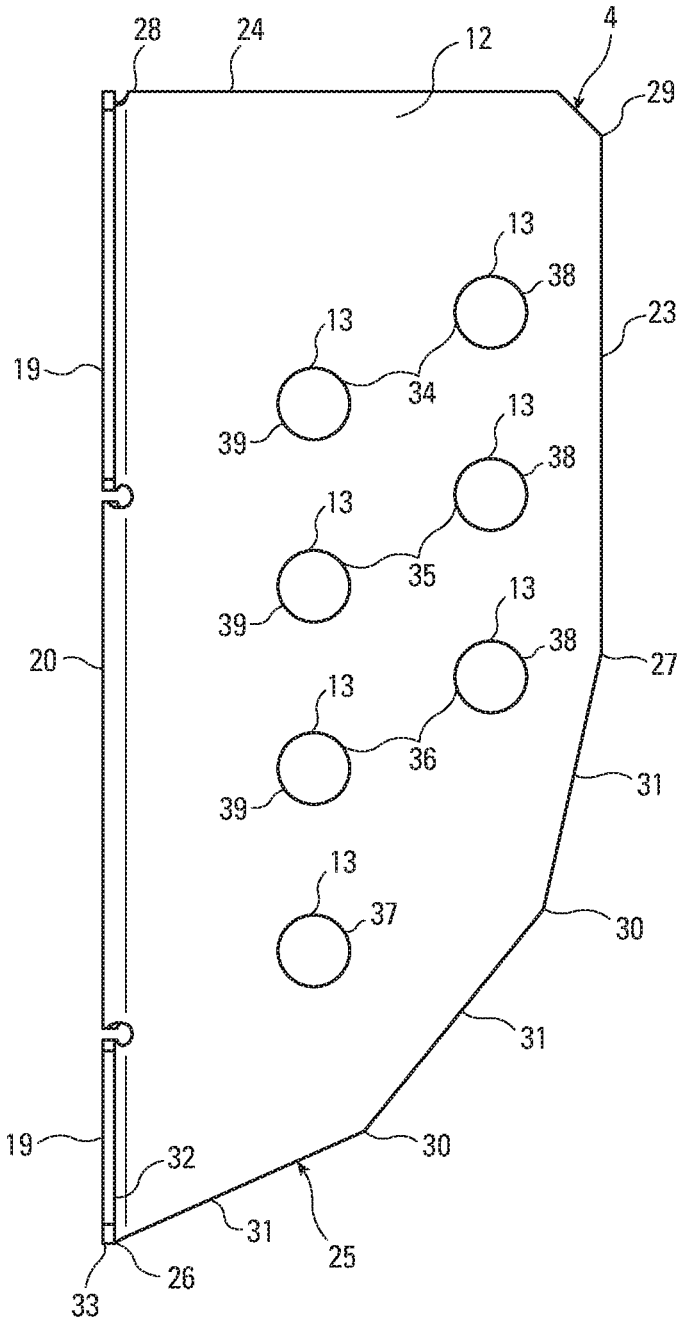
FIG. 5 is a left side view of the connector of FIG. 4.
Figure 6:
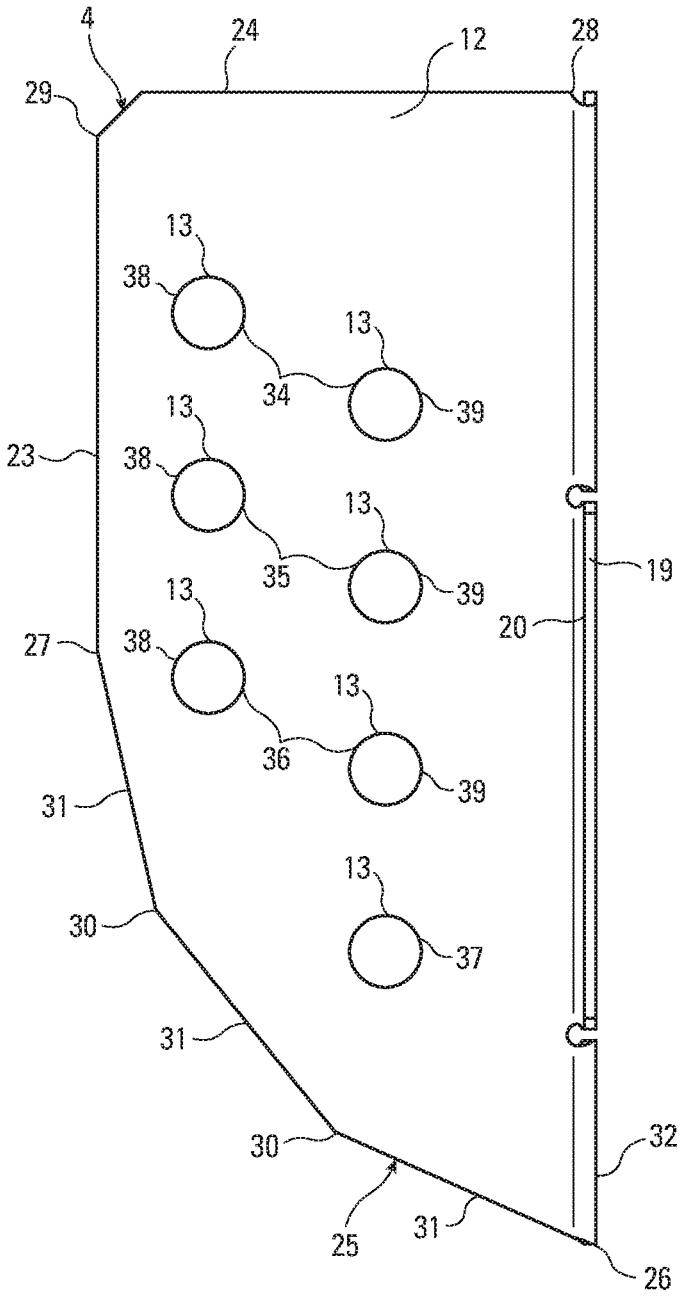
FIG. 6 is a right side view of the connector of FIG. 4.
Figure 7:
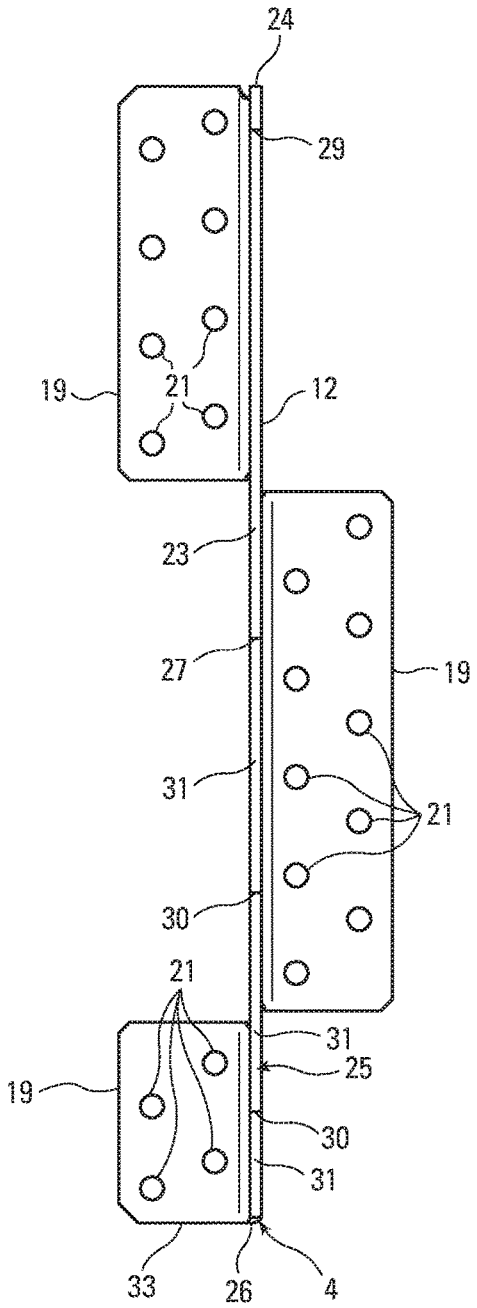
FIG. 7 is a front view of the connector of FIG. 4.
Figure 8:
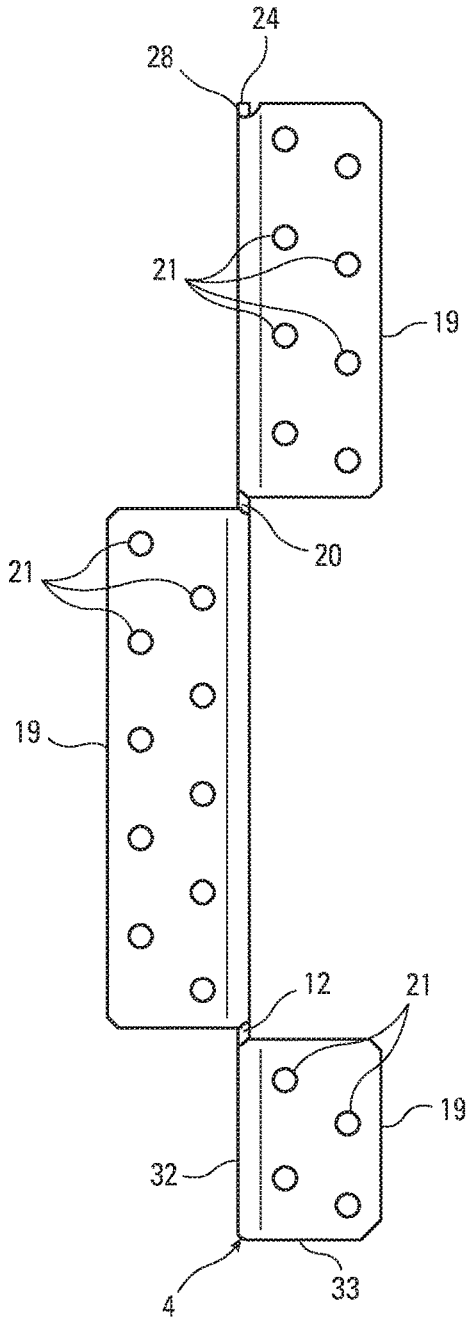
FIG. 8 is a back view of the connector of FIG. 4.
Figure 9:
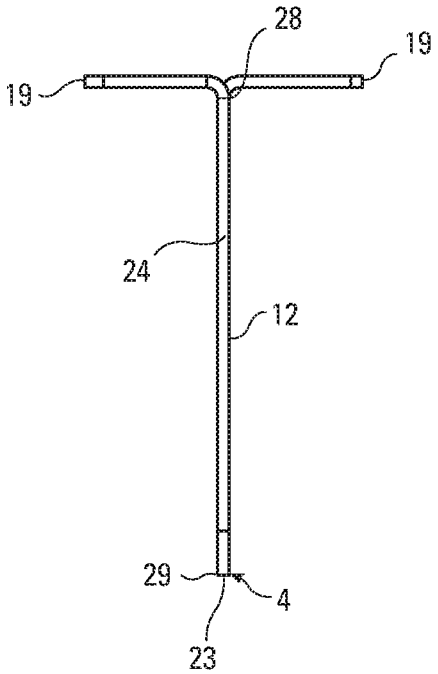
FIG. 9 is a top view of the connector of FIG. 4.
Figure 10:
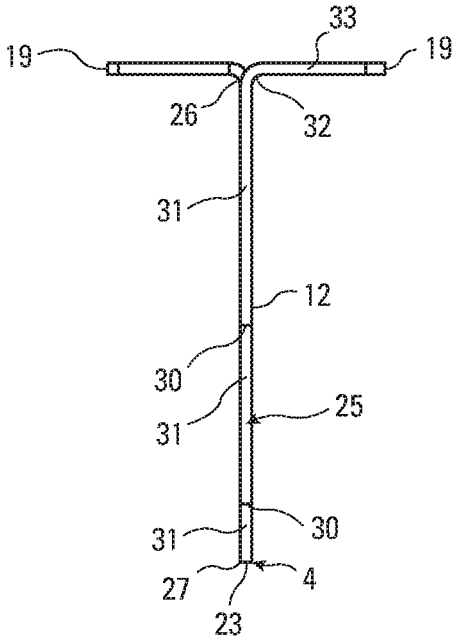
FIG. 10 is a bottom view of the connector of FIG. 4.

As shown in FIGS. 5 and 6, preferably, the angle or slope of the lower bracketing edge 25 changes at one or more intermediary points 30 spaced along the lower bracketing edge 25, and the intermediary points 30 are spaced along the lower bracketing edge 25 between the rear termination point 26 of the lower bracketing edge 25 and an outer termination point 27 of the lower bracketing edge 25. When the rear edge 20 of the attachment flange 12 is generally vertically disposed, the angle of the lower bracketing edge 25 approaches a vertical orientation as it approaches the outer edge 23 of the attachment web 12. This change in the slope of the lower bracketing segments 31 of the lower bracketing edge 25 allows the attachment web 12 to be inserted in a slot or slotted opening 14 made with a circular saw where the circular saw does not cut all the way through the second structural member 3 such that the slotted opening 14 has an arced or curved bottom wall 16 at the bottom of the slotted opening 14.

As shown in FIG. 4, a portion 32 of the rear edge 20 of the attachment web 12 that is near the rear termination point 26 and intersects with the rear termination point 26 is generally linear, and the lower bracketing edge 25 is disposed at an acute angle to the linear portion 32 of the rear edge 20 that is near and intersects with the rear termination point 26. The intermediary points 30 divide the lower bracketing edge 25 into lower bracketing segments 31 with the lower bracketing segment 31 closest to the outer edge 23 of the attachment web 12 having the least slope with respect to the linear portion 32 of the rear edge 20 near the rear termination point 26, and the lower bracketing segment 31 closest to the rear edge 20 of the attachment web 12 having the greatest slope with respect to the linear portion 32 of the rear edge 20 near the rear termination point 26.

As shown in FIGS. 4 and 5, one of the one or more fastening flanges 19 is disposed closer to the rear termination point 26 of the lower bracketing edge 25 than the others of the one or more fastening flanges 19, and the fastening flange 19 disposed closer to the rear termination point 26 has a lower edge 33 that is orthogonally or acutely disposed to the rear edge 20 of the attachment web 12 near the rear termination point 26, and the lower edge 33 of the fastening flange 19 disposed closer to the rear termination point 26 intersects with the rear edge 20 of the attachment web 12 at the rear termination point 26 of the lower bracketing edge 25 such that the rear termination point 26 of the lower bracketing edge 25 is substantially the bottom of the connector 4.

Figure 14:
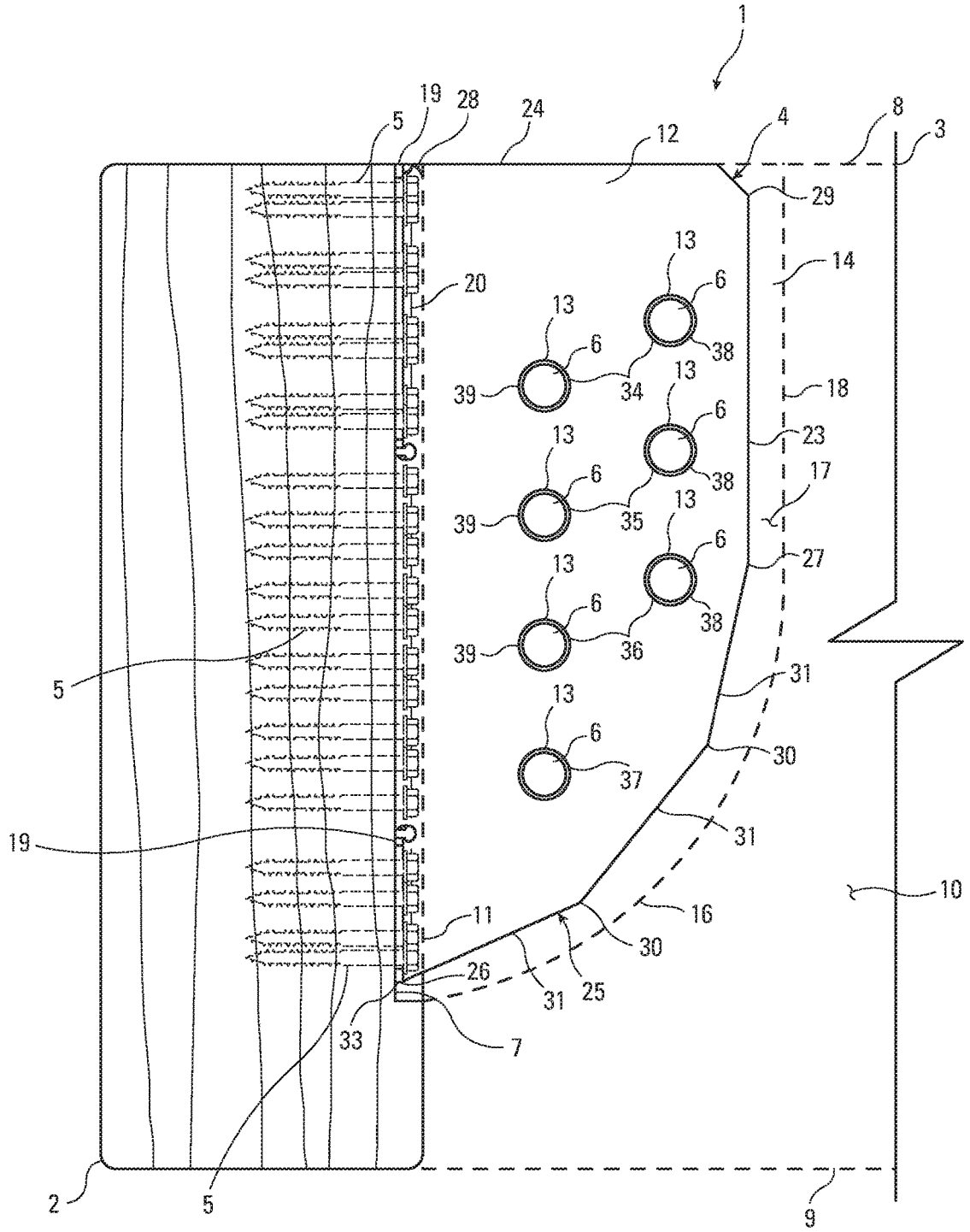
FIG. 14 is a side view of a modified form of the connection shown in FIG. 11.

To better hide the connector 4, the end of the second structural member 3 can be routed to create a cavity that receives the fastening flanges 19 and the heads of the first fasteners 5 attaching the connector 4 to the first structural member 2. Alternatively, as shown in FIG. 14 the first structural member 2 can be routed to create a cavity in which the fastening flanges 19 and the heads of the first fasteners 5 are inserted.

The elongated slotted opening 14 can be a blind slot, where the slotted opening 14 in the end or abutment surface 11 or one side surface 10 of the second structural 3 member does not communicate with any other end or sides faces 10 of the second structural member 3.

The connector 4 is preferably made from 10 gauge steel.

The connector 4 of the present invention when used with a second structural member 3 that is a glulam or parallel strand lumber beam having a width of 5⅛" and a height of 15" can achieve allowable load values for uplift of 9,210 pounds, for floor loads of 8,350 pounds, for snow loads of 8,465 pounds, and for roof loads of 8,465 pounds.

The connector 4 is preferably 13" to 14" tall. The attachment web 12 extends preferably 5.5" from the rear edge 20 to the outer edge 23 of the attachment web 12. The fastening flanges 19 are preferably 1.5" wide. The upper most fastening flange 19 is preferably 4.5" tall and receives 8 first fasteners 5. The middle fastening flange 19 is approximately 6" tall and receives 10 first fasteners 5. The lowermost fastening flange 19 is approximately 2.25" tall and receives 4 first fasteners 5. The preferred first fasteners 4 that attach the fastening flanges 19 to the first structural member 2 have a diameter of approximately 0.25" and are approximately 3" long and are self-drilling, threaded fasteners. The second fasteners 6 that connect the attachment web 12 to the second structural member 3 are preferably ½" diameter steel dowels that are approximately 4.25" long.

In the preferred form of the invention shown in FIGS. 4 and 5, the attachment web 12 extends 5.5" outwardly from the rear edge 20 to the outer edge 23. The upper bracketing edge 24 is substantially straight and disposed substantially horizontally, when the rear edge 20 of the attachment web 12 is disposed substantially vertically. The lower bracketing edge 25 of the attachment web 12 is provided with two intermediary points 30 where the slope of the lower bracketing edge 25 changes. The first intermediary point 30 is approximately 2.75" from the rear edge 20 of the attachment web 12 and approximately 1.25" above where the lower bracketing edge 25 meets the rear edge 20 of the attachment web 12 at the rear termination point 26. The second intermediary point 30 is approximately 4.75" from the rear edge 20 of the attachment web 12 and is approximately 3.75" above the point where the lower bracketing edge 25 meets the rear edge 20 of the attachment web 12. The sloping lower bracketing edge 25 meets the generally vertical outer edge 23 at an outer end point 29 that is 6.75" above where the lower bracketing edge 25 meets the rear edge 20 of the attachment web 12 at the rear termination point 26.

As shown in FIGS. 4 and 5, the attachment web 12 is formed with 7 openings 13 for receiving the second fasteners 6, the openings 13 are arranged in three pairs of a openings, an uppermost pair of openings 34, a middle pair of openings 35 and a lowermost pair of openings 36, and a lowermost single opening 37. Within each pair of openings there is an upper opening 38 and a lower opening 39 offset from the upper opening 38. The opening 13 for receiving a dowel 6 in the attachment web 12 that is closest to the upper bracketing edge 24 is located with its center 2.5" below the upper bracketing edge 24 of the attachment web 12 that overlies it. The second closest opening 13 to the upper bracketing edge 24 for receiving a dowel 6 in the attachment web 12 is located with its center approximately 1" below the opening 13 closest to the upper bracketing edge 24 and its center is also spaced 2" horizontally from the opening 13 closest to the upper bracketing edge 24. The closest opening 13 and the second closest opening 13 create the uppermost pair of openings 34. The attachment web 12 is preferably provided with two more pairs of openings 13 disposed below the uppermost pair of openings 34—a middle pair of openings 35 and a lower pair of openings 36. Within each pair of openings 34, 35 and 36, the openings 13 are spaced similarly with respect to each other. Further each lower pair of openings 35 or 36 is spaced approximately 2" below the pair of openings 34 or 35 above it. There are preferably 3 pairs of openings 34, 35 and 36 and a lowermost single opening 37 by itself which is disposed approximately 2" below the lower opening 13 in the lowest pair of openings 36.

I claim:

1. A connection between a first structural member and a second structural member made with a connector and one or more first fasteners and one or more second fasteners, the connection comprising:

a. the first structural member having an attachment surface;

b. the second structural member having an abutment surface, the second structural member having a slotted opening in the abutment surface;

c. the connector having a generally planar attachment web inserted in the slotted opening of the second structural member, the attachment web being defined by an outer edge and an oppositely disposed rear edge, an upper bracketing edge and an oppositely disposed lower bracketing edge, the connector having one or more generally planar fastening flanges connected to the rear edge of the attachment web, the one or more fastening flanges being disposed generally parallel to the attachment surface of the first structural member and at an angle to the attachment web, the one or more fastening flanges being connected to the rear edge of the attachment web by fastening flange bends that are substantially aligned with or adjacent to the rear edge of the attachment web, the one or more fastening flanges being attached to the first structural member by the one or more first fasteners, the attachment web being attached to the second structural member by the one or more second fasteners; wherein d. the lower bracketing edge has a rear termination point where the lower bracketing edge intersects with the rear edge of the attachment web, and a portion of the rear edge of the attachment web is generally linear, and the lower bracketing edge travels away from the rear termination point in a direction that is an acute angle to the linear portion of the rear edge, and the outer edge of the attachment web is disposed within the elongated slot in the second structural member; wherein e. the angle or slope of the bracketing edge changes at one or more intermediary points spaced along the bracketing edge, and the intermediary points occur along the lower bracketing edge between the rear termination point of the lower bracketing edge and an outer termination point of the lower bracketing edge where the lower bracketing edge meets the outer edge of the attachment web.

2. The connection of claim 1, wherein:

one of the one or more fastening flanges is disposed closer to the rear termination point of the lower bracketing edge than the others of the one or more fastening flanges, and the fastening flange disposed closer to the rear termination point has a lower edge that is orthogonally or acutely disposed to the rear edge of the attachment web, and the lower edge of the fastening flange disposed closer to the rear termination point intersects with the rear edge of the attachment web at the termination point of the lower bracketing edge such that the termination point of the lower bracketing edge is substantially the bottom of the connector.

3. The connection of claim 1, wherein:

the second structural member has a top surface that meets the abutment surface, and the elongated slot formed in the second structural member only is open with respect to the abutment surface and the top surface of the second structural member.

4. The connection of claim 1, wherein:

the slotted opening provided in the second structural member is formed with a circular saw.

5. The connection of claim 1, wherein:

the abutment surface of the second structural member overlies the one or more fastening flanges of the connector.

6. The connection of claim 1, wherein:

a. the second structural member is a glulam or parallel strand lumber beam having a width of 5⅛" and a height of 15", and the connection achieves allowable load values for uplift of 9,210 pounds, for floor loads of 8,350 pounds, for snow loads of 8,465 pounds, and for roof loads of 8,465 pounds;

b. the connector is made from 10 gauge steel, the connector is no more than 14" tall, the attachment web extends no more than 5.5" from the rear edge to the outer edge of the attachment web, and the fastening flanges are no more than 1.5" wide;

c. the first fasteners that attach the fastening flanges to the first structural member are 22 self-drilling steel screws having a diameter of approximately ¼"; and d. the second fasteners that attach the attachment web to the second structural member are 7 steel dowels having diameter of approximately ½".

7. The connection of claim 1, wherein:

the connector is formed with a plurality of fastening flanges with the uppermost fastening flange and the lowermost fastening flange being bent to one side of the attachment web, and a fastening flange disposed between the uppermost fastening flange and the lowermost fastening flange being bent to the opposite side of the attachment web.

8. The connection of claim 7, wherein:

a. there are three fastening flanges;

b. the first fasteners that attach the fastening flanges to the first structural member are 22 self-drilling steel screws having a diameter of approximately ¼";

c. the second fasteners that attach the attachment web to the second structural member are 7 steel dowels having diameter of approximately ½";

d. the second structural member is a glulam or parallel strand lumber beam having a width of 5⅛" and a height of 15", and the connection achieves allowable load values for uplift of 9,210 pounds, for floor loads of 8,350 pounds, for snow loads of 8,465 pounds, and for roof loads of 8,465 pounds; and e. the connector is made from 10 gauge steel, the connector is no more than 14" tall, the attachment web extends no more than 5.5" from the rear edge to the outer edge of the attachment web, and the fastening flanges are no more than 1.5" wide.

9. A connection between a first structural member and a second structural member made with a connector and one or more first fasteners and one or more second fasteners, the connection comprising:

a. the first structural member having an attachment surface;

b. the second structural member having an abutment surface, the second structural member having a slotted opening in the abutment surface;

c. the connector having a generally planar attachment web inserted in the slotted opening of the second structural member, the attachment web being defined by an outer edge and an oppositely disposed rear edge, an upper bracketing edge and an oppositely disposed lower bracketing edge, the connector having one or more generally planar fastening flanges connected to the rear edge of the attachment web, the one or more fastening flanges being disposed generally parallel to the attachment surface of the first structural member and at an angle to the attachment web, the one or more fastening flanges being connected to the rear edge of the attachment web by fastening flange bends that are substantially aligned with or adjacent to the rear edge of the attachment web, the one or more fastening flanges being attached to the first structural member by the one or more first fasteners, the attachment web being attached to the second structural member by the one or more second fasteners; wherein d. the lower bracketing edge has a rear termination point where the lower bracketing edge intersects with the rear edge of the attachment web, and a portion of the rear edge of the attachment web is generally linear, and the lower bracketing edge travels away from the rear termination point in a direction that is an acute angle to the linear portion of the rear edge, and the outer edge of the attachment web is disposed within the elongated slot in the second structural member; wherein e. the attachment web is formed with 7 openings for receiving the second fasteners, the openings are arranged in three pairs of a openings, an uppermost pair of openings, a middle pair of openings and a lowermost pair of openings, and a lowermost single opening, within each pair of openings there is an upper opening and a lower opening offset from the upper opening, with the lower opening being located with its center approximately 1" below the upper opening of the pair of openings and its center also being spaced 2" horizontally from the upper opening of the pair of openings;

f. the upper opening of the uppermost pair is located with its center 2.5" below the upper bracketing edge of the attachment web, and the upper opening of each pair of openings is spaced approximately 2" below the upper opening of the pair of openings above; the single lowermost opening is disposed approximately 2" below the lower opening in the lowermost pair of openings.

10. A connection between a first structural member and a second structural member made with a connector and one or more first fasteners and one or more second fasteners, the connection comprising:

a. the first structural member having an attachment surface;

b. the second structural member having an abutment surface, the second structural member having a slotted opening in the abutment surface;

c. the connector having a generally planar attachment web inserted in the slotted opening of the second structural member, the attachment web being defined by an outer edge and an oppositely disposed rear edge, an upper bracketing edge and an oppositely disposed lower bracketing edge, the connector having one or more generally planar fastening flanges connected to the rear edge of the attachment web, the one or more fastening flanges being disposed generally parallel to the attachment surface of the first structural member and at an angle to the attachment web, the one or more fastening flanges being connected to the rear edge of the attachment web by fastening flange bends that are substantially aligned with or adjacent to the rear edge of the attachment web, the one or more fastening flanges being attached to the first structural member by the one or more first fasteners, the attachment web being attached to the second structural member by the one or more second fasteners; wherein d. the lower bracketing edge has a rear termination point where the lower bracketing edge intersects with the rear edge of the attachment web, and a portion of the rear edge of the attachment web is generally linear, and the lower bracketing edge travels away from the rear termination point in a direction that is an acute angle to the linear portion of the rear edge, and the outer edge of the attachment web is disposed within the elongated slot in the second structural member; wherein e. the slotted opening in the second structural member has a pair of generally parallel slot walls that are joined by generally straight front face, and by a generally curved bottom wall have a single radius of curvature.

11. The connection of claim 10, wherein:

the angle or slope of the bracketing edge changes at one or more intermediary points spaced along the bracketing edge, and the intermediary points occur along the lower bracketing edge between the rear termination point of the lower bracketing edge and an outer termination point of the lower bracketing edge where the lower bracketing edge meets the outer edge of the attachment web.

12. The connection of claim 11, wherein:

the second structural member has a top surface that meets the abutment surface, and the elongated slot formed in the second structural member only is open with respect to the abutment surface and the top surface of the second structural member.

13. The connection of claim 12, wherein:

the connector is formed with a plurality of fastening flanges with the uppermost fastening flange and the lowermost fastening flange being bent to one side of the attachment web, and a fastening flange disposed between the uppermost fastening flange and the lowermost fastening flange being bent to the opposite side of the attachment web.

14. The connection of claim 13, wherein:

one of the one or more fastening flanges is disposed closer to the rear termination point of the lower bracketing edge than the others of the one or more fastening flanges, and the fastening flange disposed closer to the rear termination point has a lower edge that is orthogonally or acutely disposed to the rear edge of the attachment web, and the lower edge of the fastening flange disposed closer to the rear termination point intersects with the rear edge of the attachment web at the termination point of the lower bracketing edge such that the termination point of the lower bracketing edge is substantially the bottom of the connector.

15. The connection of claim 14, wherein:

a. the attachment web is formed with 7 openings for receiving the second fasteners, the openings are arranged in three pairs of a openings, an uppermost pair of openings, a middle pair of openings and a lowermost pair of openings, and a lowermost single opening, within each pair of openings there is an upper opening and a lower opening offset from the upper opening, with the lower opening being located with its center approximately 1" below the upper opening of the pair of openings and its center also being spaced 2" horizontally from the upper opening of the pair of openings;

b. the upper opening of the uppermost pair is located with its center 2.5" below the upper bracketing edge of the attachment web, and the upper opening of each pair of openings is spaced approximately 2" below the upper opening of the pair of openings above; the single lowermost opening is disposed approximately 2" below the lower opening in the lowermost pair of openings.

16. The connection of claim 15, wherein:

a. there are three fastening flanges;

b. the first fasteners that attach the fastening flanges to the first structural member are 22 self-drilling steel screws having a diameter of approximately ¼";

c. the second fasteners that attach the attachment web to the second structural member are 7 steel dowels having diameter of approximately ½".

17. The connection of claim 16, wherein:

a. the second structural member is a glulam or parallel strand lumber beam having a width of 5⅛" and a height of 15", and the connection achieves allowable load values for uplift of 9,210 pounds, for floor loads of 8,350 pounds, for snow loads of 8,465 pounds, and for roof loads of 8,465 pounds;

b. the connector is made from 10 gauge steel, the connector is no more than 14" tall, the attachment web extends no more than 5.5" from the rear edge to the outer edge of the attachment web, and the fastening flanges are no more than 1.5" wide;

c. the first fasteners that attach the fastening flanges to the first structural member are 22 self-drilling steel screws having a diameter of approximately ¼"; and d. the second fasteners that attach the attachment web to the second structural member are 7 steel dowels having diameter of approximately ½".

18. The connection of claim 17, wherein:

the slotted opening provided in the second structural member is formed with a circular saw.

19. The connection of claim 18, wherein:

the abutment surface of the second structural member overlies the fastening flanges of the connector.

* * * * *